US005156348A

United States Patent [19]

Inger

[11] Patent Number: 5,156,348

[45] Date of Patent: Oct. 20, 1992

[54] THREAD MONITORING MECHANISM

[75] Inventor: Siegfried Inger, Tönisvorst, Fed. Rep. of Germany.

[73] Assignee: Palitex Project Company GmbH, Krefeld, Fed. Rep. of Germany

[21] Appl. No.: 604,841

[22] Filed: Oct. 26, 1990

[30] Foreign Application Priority Data

Oct. 28, 1989 [DE] Fed. Rep. of Germany ..... 3936045

[51] Int. Cl.[5] ..... B65H 63/00

[52] U.S. Cl. ..... 242/36; 226/44; 242/37 R; 242/49; 242/147 R

[58] Field of Search ..... 242/147 R, 36, 37 R, 242/49, 28, 29, 148; 226/44, 45, 24, 11, 43; 57/81, 80

[56] References Cited

U.S. PATENT DOCUMENTS

| | | | |
|---|---|---|---|
| 2,734,334 | 2/1956 | Saunders et al. | 242/37 R X |
| 3,680,753 | 8/1972 | Shaw-Stewart | 226/44 X |
| 4,896,808 | 1/1990 | Bolza-Schunemann et al. | 226/44 X |

FOREIGN PATENT DOCUMENTS

| | | |
|---|---|---|
| 1535167 | 1/1971 | Fed. Rep. of Germany . |
| 2939435 | 9/1973 | Fed. Rep. of Germany . |
| 2309094 | 4/1981 | Fed. Rep. of Germany . |

*Primary Examiner*—Stanley N. Gilreath
*Attorney, Agent, or Firm*—Bell, Seltzer, Park & Gibson

[57] ABSTRACT

A thread monitoring mechanism for a thread processing location with a swivel lever which is mounted on a swivel axis and on which a thread guidance roller overrun by the thread that is to be monitored is mounted and which is elastically supported by a supporting member adjustable in accordance with a predetermined thread tension, in which respect the swivel lever has a switching member for interrupting the thread travel and/or for switching-off the thread processing location as soon as the actual thread tension deviates by a specific amount from a predetermined thread tension value, is characterized in that the suporting member is pneumatically supported, in which respect serving for supporting the swivel lever are preferably two supporting members which are supported pneumatically by membranes which have effective membrane surfaces of different sizes.

9 Claims, 4 Drawing Sheets

THREAD MONITORING MECHANISM

FIELD AND BACKGROUND OF THE INVENTION

The invention relates to a thread monitoring mechanism.

Thread monitoring mechanisms are arranged in the thread run of a textile machine, and, in general can be differentiated into non-contact monitoring mechanisms and those, as in the case with which the invention is concerned, which butt in sensing manner against the thread, and are called thread sensors.

Conventional thread sensors emit a Yes/No signal, namely "Thread is present" or "Thread is not present". Upon the production of twisted yarn, at least two thread components participate in the total thread, so that, besides the knowledge regarding the Yes/No state, also knowledge regarding the presence of only one thread component is desirable. The same also holds true for so-called cabling threads, which contain two yarn components which run in over different yarn paths and which combine only underneath the balloon thread guide in the so-called cording triangle. In both cases it could, upon breakage of only one yarn or respectively thread component, lead to a condition in which the second yarn component holds the thread sensor in its operating position, so that the thread sensor does not respond and thus only one yarn strand is wound.

In order to prevent such a faulty winding, so-called differential thread tension sensors are provided, i.e. thread sensors which not only have the Yes/No function as their content, but also react upon a variation of the overall tension, for example upon omission of one yarn component.

A typical differential thread tension sensor for a cabling machine is described for example in DE-OS 29 39 435. This known thread sensor generally comprises a swivel lever which is mounted on a swivel axis and on which a thread guidance roller, overrun by the thread that is to be monitored, is mounted. The swivel lever is supported in the operating position corresponding to an orderly thread run by a helical compression spring which can be adjusted by means of an adjusting screw in such a way that also upon breakage of one thread or respectively yarn component, and thus e.g. halved thread tension, the swivel lever is swivelled, under the action of the helical compression spring, into a switching position which interrupts the operation of the thread processing location, although the other yarn component continues to run over the sensing roller, i.e. upon tearing of a single one of the two yarn or respectively thread components the thread processing location is stopped. It is self-evident that upon tearing of both yarn components likewise a shut-down of the thread processing location is effected.

Described in DE-AS 15 35 167 is a thread sensor in the form of a two-armed swivel lever on the one arm of which a tension spring acts, whilst the other arm carries a sensing pin which is overrun by the thread. This thread sensor is designed as a differential thread tension sensor, which however also reacts upon overload, i.e. this thread sensor responds both upon thread breakage or falling-below of a predetermined thread tension on the one hand and upon the exceeding of a predetermined thread tension on the other hand, in that for example upon abatement of the thread tension the swivel lever is swivelled, under the effect of the spring acting on it, in the clockwise direction, whilst upon an increase in the thread tension the swivel lever is swivelled contrary to the force of the tension spring in the anticlockwise direction.

A disadvantage of these two known spring-loaded thread sensors is that an adaptation or variation of the spring force aimed at a specific thread tension is possible only in the region of an individual thread sensor, which, more particularly in the case of multi-location machines is complex and time-consuming.

OBJECT AND SUMMARY OF THE INVENTION

An object of the invention is to enable the aforementioned disadvantages to be reduced or avoided.

According to the present invention there is generally provided a thread monitoring mechanism comprising a swivel lever which is mounted on a swivel axis, a thread guidance roller mounted on the swivel lever for engaging a thread, a switching member on the switch lever for interrupting the thread travel and/or for switching-off a thread processing location as soon as the actual thread tension deviates materially from a predetermined thread tension value; wherein the swivel lever is supported by pneumatically controlled support means against thread tension to permit said predetermined thread tension value to be varied by adjustment of the pressure applied to the support means.

The invention thus provides a thread monitoring mechanism, especially for multi-location machines, which makes possible centralized adjustment of the sensing or switching characteristics of the thread monitoring mechanisms for many locations or an entire machine.

The pneumatically controlled support means advantageously comprises a plurality of pneumatic devices each of which can be selectively pressurised to support the swivel lever. Each pneumatic device preferably comprises a support member, such as a piston or push rod, acted upon by pressure, e.g. via a diaphragm, piston or an elastically deformable member which is directly exposed to the pneumatic pressure.

The present invention further provides a thread monitoring mechanism, for a thread processing location, comprising a swivel lever which is mounted on a swivel axis and on which a thread guidance roller, to be overrun by the thread that is to be monitored, is mounted and which is supported by an adjustably supported supporting member, wherein the swivel lever has a switching member for interrupting the thread travel and/or for switching-off the thread processing location when the actual thread tension deviates unacceptably from a predetermined thread tension value; wherein in that the swivel lever is supportable by a second supporting member; and wherein both supporting members are supported by pneumatic devices.

Such pneumatically controlled mechanisms are suitable more especially for the central adjustment of the sensing or switching characteristics desired over an entire machine, in which respect the pneumatic support by means of two supporting members makes it possible to connect the pneumatic sensing mechanism up to the conventional compressed-air operating network. Such operating networks are usually permissible up to 6 bar. Taking into account pressure fluctuations in the network, an actual operating pressure of between 0.2 and 5 bar is available, i.e. conversion of this pressure difference taking as the basis a specific working surface area at the same time represents the limit which in the case of a thread sensing mechanism is available as counter-force to the thread tensile force. Taking into account the respective working conditions, such a pressure difference is often not sufficient to cover the working range and the thread tensile forces underlying this working range e.g. on a cabling machine. The same holds true from case to case also for two-for-one twisting machines.

The double pneumatic support, in accordance with the invention, of the swivel lever provides, in contrast, for a given operating air pressure the possibility of increasing the working range of the sensing mechanism, in that two supporting members supporting the swivel lever individually or jointly are provided.

Each supporting member can preferably be a piston which butts loosely against the swivel lever and which is supported by an elastically deformable membrane, which on its side remote from the piston can be acted upon with compressed air.

In this respect the effective or working area of the membrane surface of the one membrane is preferably chosen to be as small as possible, in order to encompass a working range of low yarn tension, in which respect the upper limit of the working range of this first membrane is predetermined by the possible pressure difference of the operating pneumatic network which is available.

In order to widen the working range of the thread sensor, the second membrane, parallel to the first one, preferably has a correspondingly larger effective or working area, in which respect the membrane surfaces are so co-ordinated to one another that an adequate degree of overlap of the working ranges is still ensured.

Both membranes are connected to a common source of compressed air and are preferably acted upon via a pressure regulator with the desired pressure. Behind the pressure regulator the compressed-air supply line is subdivided, a respective one of the line branches each leading to a respective one of the two membranes. As a result of switching-on and/or switching-off the compressed air for the one or the other membrane, a pressure or supporting force can be generated which counteracts the respective thread tensile force or thread tension.

In a further preferred embodiment to the invention, the swivel lever is supported by a further supporting member which becomes effective for the interruption of the thread travel and/or for the switching-off of the thread processing location as soon as the actual thread tension exceeds the predetermined tension value by a specific magnitude. In this way the differential thread tension sensor in accordance with the invention also has the function of an overload safety device.

In order to allow the thread sensor to become effective both upon fall-off of the thread tension and upon increase in the thread tension, the switching member is preferably arranged so that, upon swivelling of the lever in either direction, the switching member acts on an adjusting member which electrically or pneumatically controls a switch-off of the thread processing location.

In a further preferred embodiment of the invention, a stop which can be adjusted up to the swivel lever is provided for the temporary arresting of the swivel lever in an operating position corresponding to the orderly thread travel, in order to put the thread sensor temporarily out of action during the thread loading at the working location. For this, a rotary lever is provided, with which the swivel lever can be blocked, in order during the thread feeding, with not yet proper thread tension, to prevent a switching-through of the sensing mechanism.

The invention further provides a textile machine incorporating a plurality of the thread sensors or monitoring mechanisms of the invention, wherein the pneumatic devices are connected into a common pneumatic control system.

BRIEF DESCRIPTION OF THE DRAWINGS

An embodiment of the invention will be described in more detail hereinunder with reference to the accompanying diagrammatic drawings, in which.

DETAILED DESCRIPTION OF PREFERRED EMBODIMENT OF THE INVENTION

Figure 1:
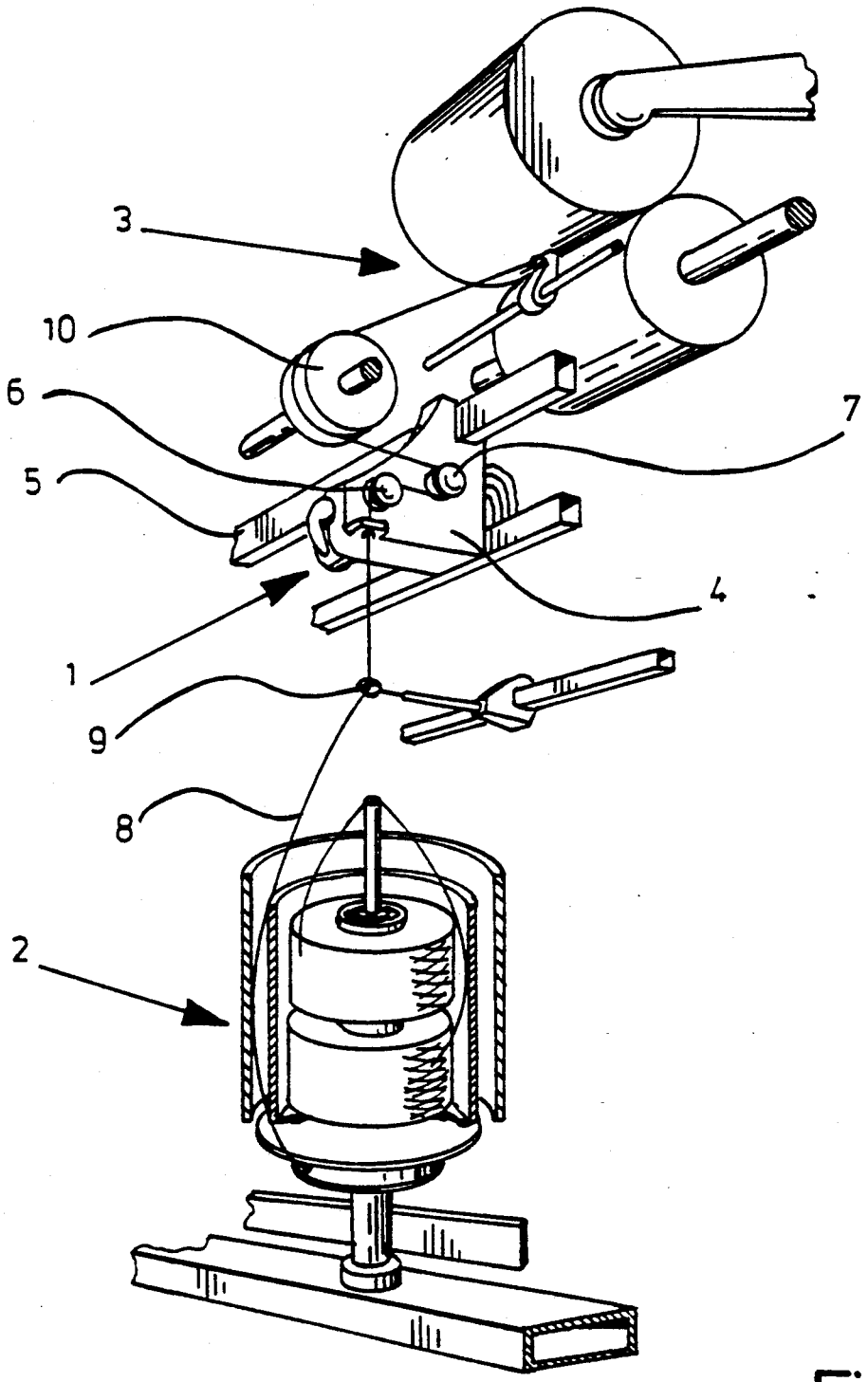
FIG. 1 shows, partially in perspective, a side view of a two-for-one twisting spindle with associated winding unit and interposed thread monitoring mechanism.

FIG. 1 shows the thread monitoring mechanism 1 in association with a two-for-one twisting spindle 2, namely interpolated between the two-for-one twisting spindle 2 and a thread winding unit 3. Of the thread monitoring mechanism, FIG. 1 shows the thread sensor housing 4 fastened stationarily to one or more machine longitudinal members 5 as well as two thread guidance rollers 6 and 7 which are looped around by the thread 8 on the way from the balloon thread guide 9 to a lead roller 10 connected prior to the winding unit 3.

Figure 2:
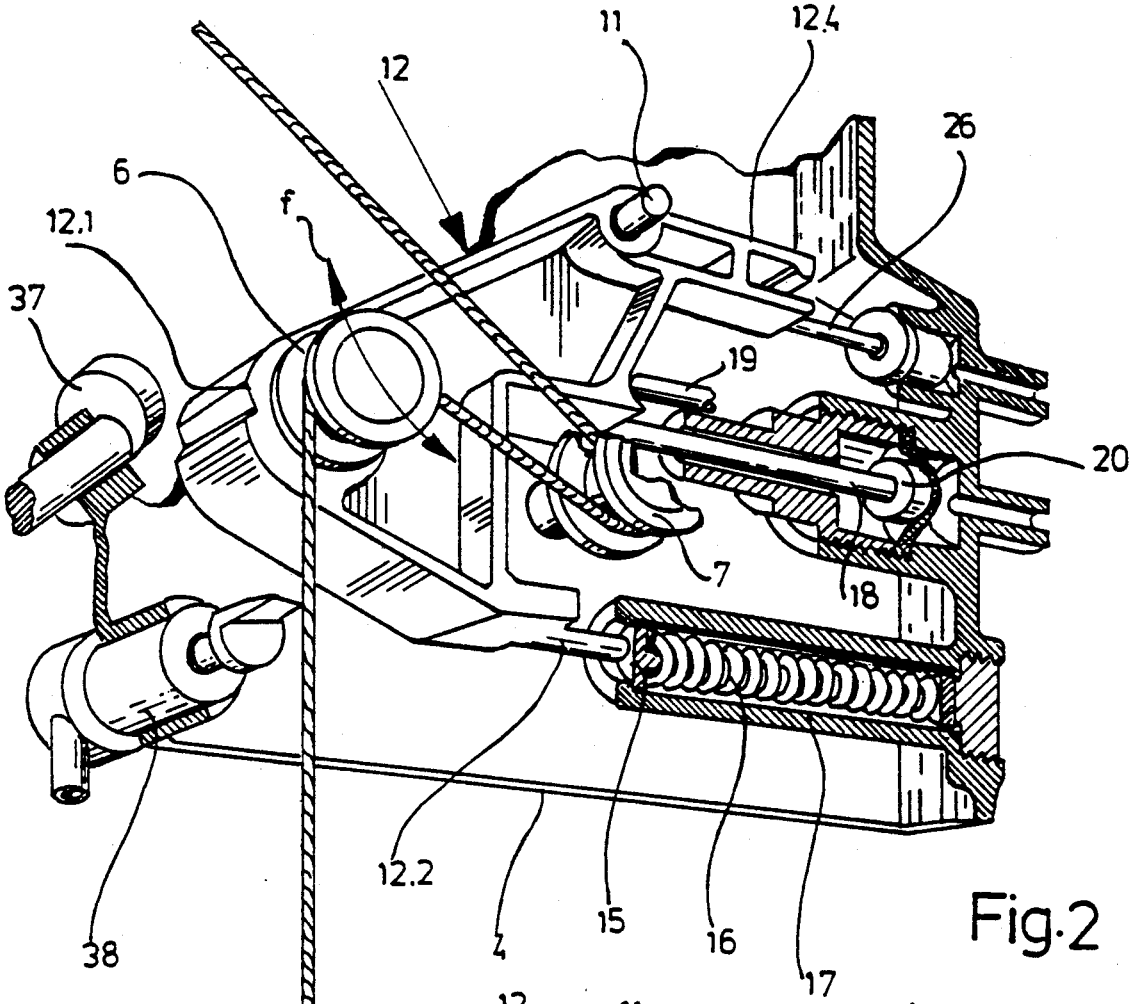
FIG. 2 shows, in perspective enlarged representation partially in section, a side view of the thread monitoring mechanism in accordance with the invention.

Referring to FIG. 2, mounted in the thread sensor housing 4 is a double-armed swivel lever 12 which can be swivelled about the swivel axis 11 and on the first lever arm 12.1 of which the thread guidance roller 6 is mounted for rotation about the axis 13. The second thread guidance roller 7 is mounted on the wall of the thread sensor housing 4 so as to be rotatable about the axis 14.

The lever arm 12.1 is supported by a supporting member 12.2 on a pressure plate 15, which for its part is supported by a compression spring 16, which, in the same way as the pressure plate 15, is guided in a tubular portion 17 of the thread sensor housing 4. The characteristic of the compression spring 16 is so designed that, taking into account the lever-arm spacings as far as the swivel axis 11, it yields only upon such thread tensile forces or respectively thread tensions which exceed the thread tensions during the normal process or respectively during the orderly thread travel by a previously set degree.

Figure 4:
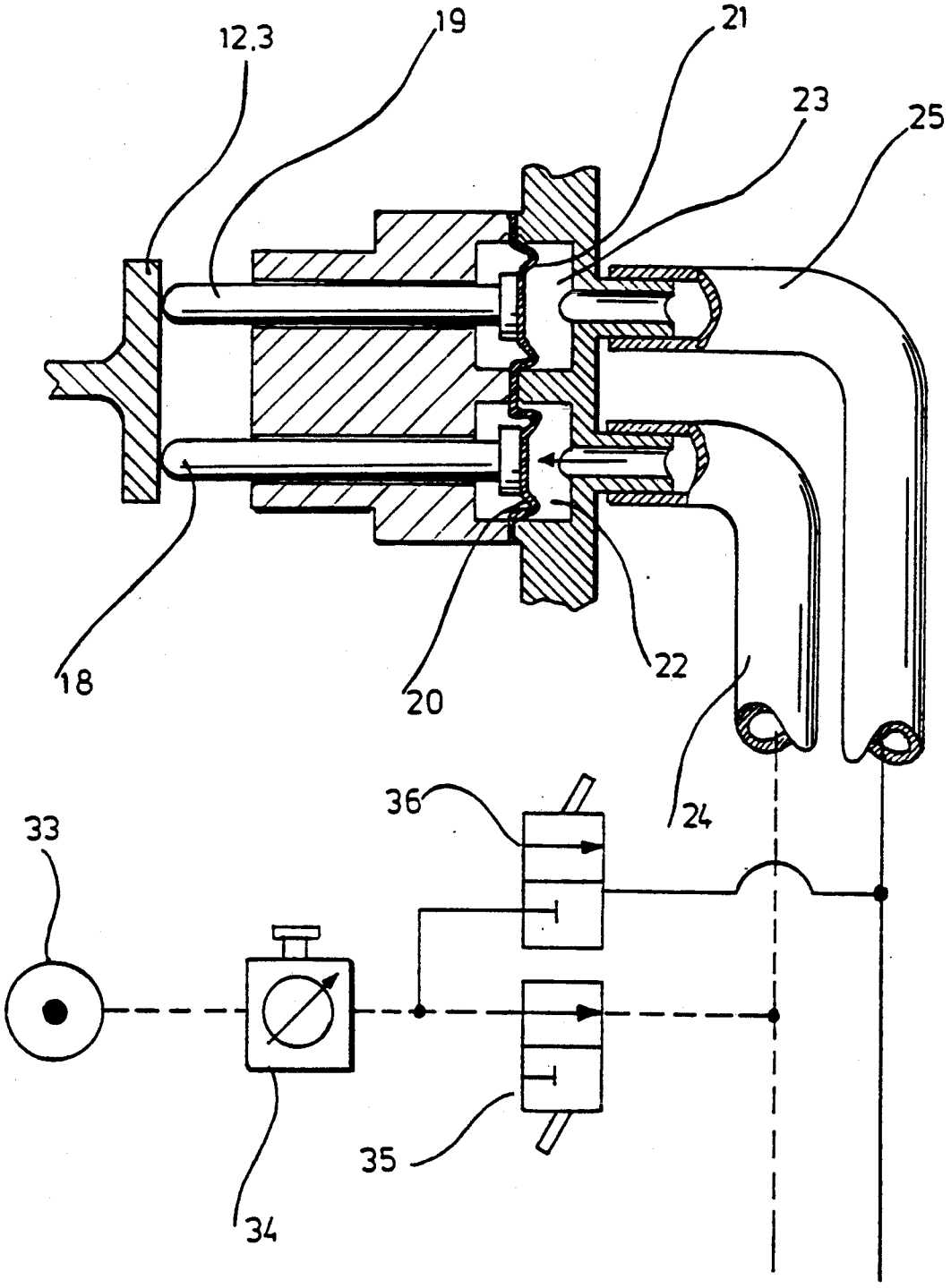
FIG. 4 shows, in enlarged representation, a diagrammatic view of the pneumatic circuit with the associated membrane-controlled supporting members.

The first lever arm 12.1 has a shoulder 12.3 (see also FIG. 4), supported by pneumatically controlled support means comprising two supporting members 18 and 19 in the form of pistons which butt against the shoulder 12.3. The two pistons 18 or respectively 19 are supported by two pneumatic devices in the form of elastically deformable membranes 20 or respectively 21, which with their membrane sides remote from the pistons 18 or respectively 19 close off pressure chambers 22 or respectively 23 into which pressure lines 24 or respectively 25 open. The membranes 20 or respectively 21 supporting the pistons 18 or respectively 19 have effective membrane surfaces of different sizes.

The second lever arm 12.4 of the swivel lever 12 is formed as a fork-shaped switching member, between the two fork prongs of which there projects a switching pin 26, which is positioned on a valve plate 28 which bears a seal 27. The valve plate closes off, together with the seal 27, a valve opening of a pressure chamber 29, into which a compressed-air line 30 opens. The valve plate 28 as well as the seal 27 are, upon orderly thread travel, forced against the valve seat 32. The pressure chambers or respectively pressure spaces 22, 23 and 29 form a part of the stationary thread sensor housing 4.

The pressure chambers 22 or respectively 23 sealed off by the two membranes 20 and 21 are connected to a joint source 33 of compressed air along with interpolation of a pressure regulator 34. Behind the pressure regulator 34 the compressed-air line splits up into two line branches which lead to the pressure lines 24 or respectively 25. Each of the two line branches is provided with a switching valve 35 or respectively 36, in order by appropriate switch-over to act upon one membrane or the other membrane or both membranes 20, 21 jointly with compressed air, so that the swivel lever is supported by way of its supporting shoulder 12.3 either by one of the two pistons 18 or respectively 19 or by both pistons 18, 19, in order to support the swivel lever, contrary to the thread tension or respectively thread tensile force acting on it, in an operating position corresponding to an orderly thread travel. The variation possibilities for supporting the swivel lever with a specific force will be described hereinunder with reference to one possible example:

The first membrane 20 having a smaller effective membrane surface covers for example the working range from 25 up to 250 cN thread tensile force. The second larger membrane 21 has an effective membrane surface which corresponds for example to a working range of 240 up to 480 cN, namely in each case as a function of the pressures set by means of the pressure regulator 34 in the pressure spaces 22 or respectively 23.

The two working ranges of the membranes 20 and 21 overlap in the case of the described example by 10 cN of thread tensile force.

If a thread tension in a range up to 250 cN thread tensile force is to be monitored, then it is sufficient solely to act upon the pressure space 22 of the smaller first membrane 20 with compressed air. If a tensile force of for example 260 cN is to be monitored, the first smaller membrane 20 can be relieved, whilst the second larger membrane 21 is activated.

In the event that a maximum tensile force is to be controlled or respectively monitored, both membranes can be activated, so that altogether a force of 250 $cN+480\ cN=730\ cN$ is available.

Figure 5:
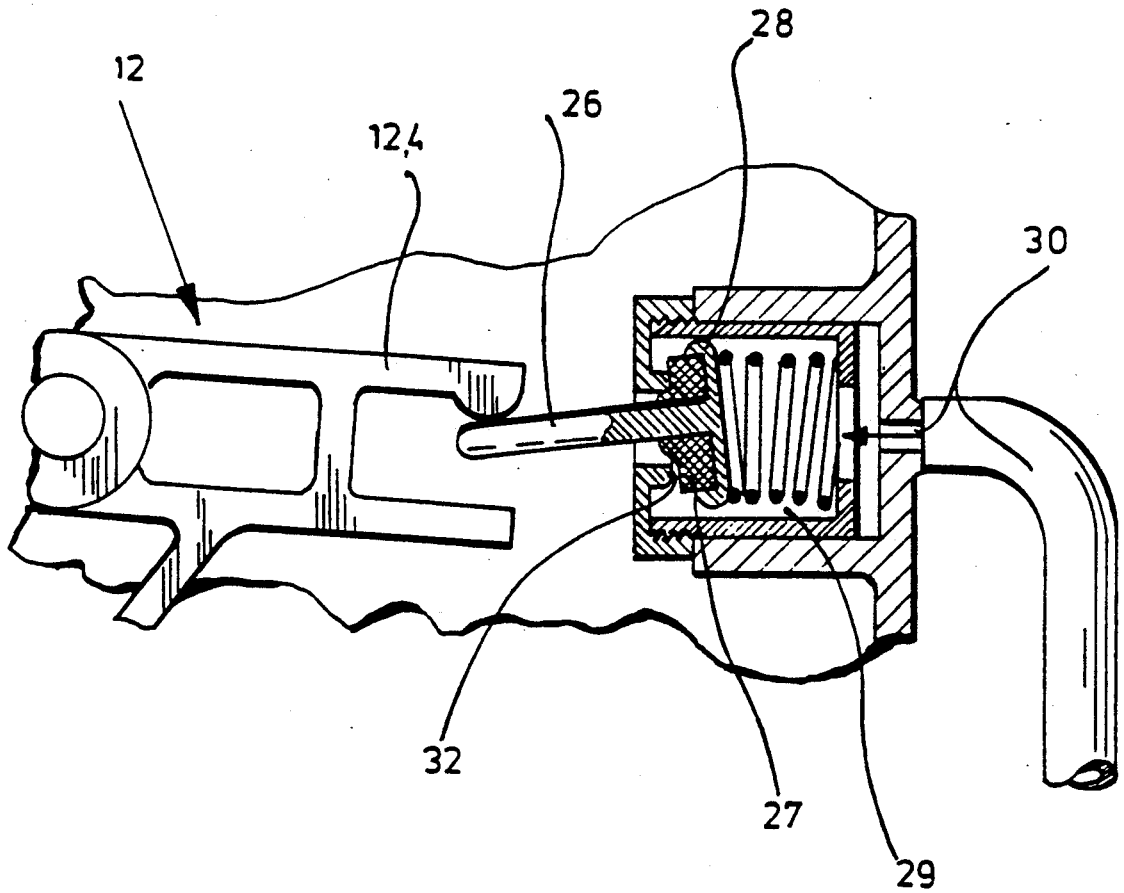
FIG. 5 shows, partially in section, a side view of the switching and adjusting members.

If for example upon breakage of the thread 8 or upon breakage of a yarn component of the thread 8 the thread tension and thus the thread tensile force decreases, the swivel lever 12 is swivelled by one of the two supporting members 18 or respectively 19 or by both supporting members in the clockwise direction, so that the fork-shaped switching member 12.4 presses with its upper fork tines against the switching pin 26. In this way, in the manner described in FIG. 5, the valve plate 28 lifted off from the valve seat 32, so that the pressure chamber 29 is vented, which leads to a pressure drop in the compressed-air line 30. This pressure drop causes appropriate control commands for the shut-down of the thread processing location, in the described instance of the two-for-one twisting spindle 2.

If, on the other hand, the thread tension increases for any reason, then the swivel lever can, as a function of the spring force of the compression spring 16 supporting the supporting member 12.2, be swivelled against the force of this compression spring 16 in the anticlockwise direction, whereby the lower fork tine of the fork-shaped switching member 12.4 acts on the switching pin 26, in order to bring about in the compressed-air line 30 a pressure drop, from which appropriate control commands are derived.

Figure 3:
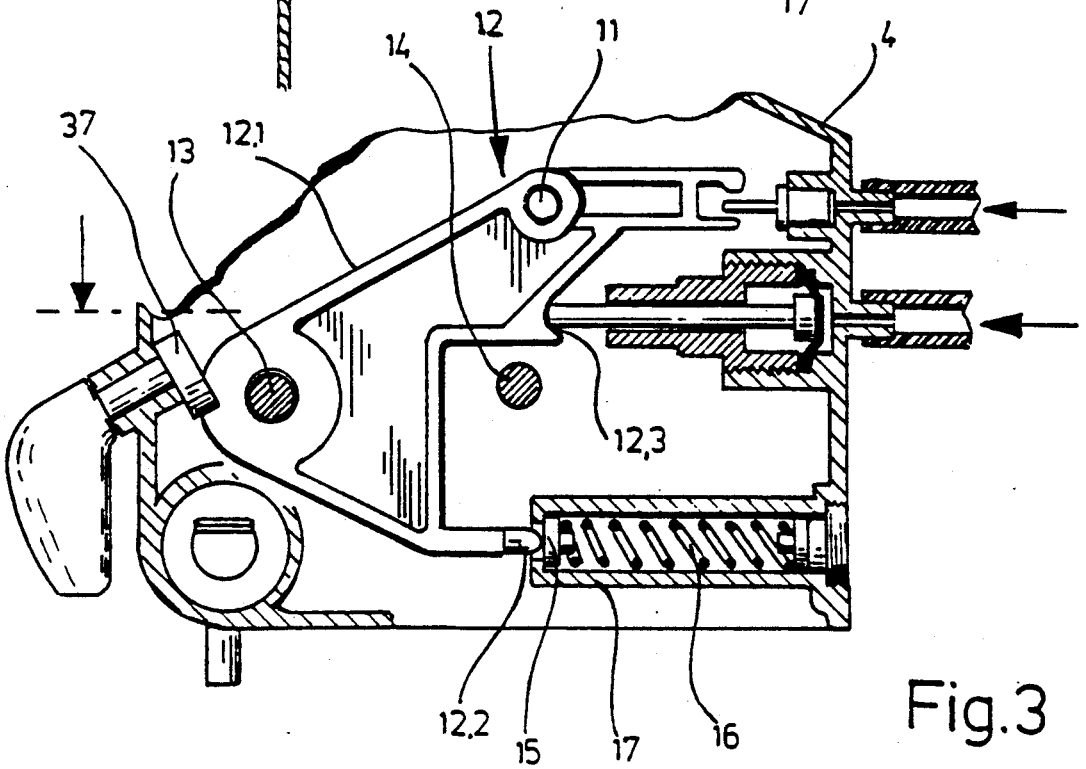
FIG. 3 shows, partially in section, a side view of the thread sensor.

As shown in FIGS. 2 and 3, associated with the swivel lever 12 is a swivellable or rotatable stop 37, which serves for the temporary arresting of the swivel lever in an operating position corresponding to the orderly thread travel. This stop is to set the thread monitoring member or respectively the thread sensor during the thread loading temporarily out of action, in order during the thread application with not yet orderly thread tension to prevent a switching-through of the sensing mechanism.

As shown in FIG. 2 arranged on the housing 4 of the thread monitoring mechanism 1 is additionally a pneumatically actuated thread separating member 38 of any desired design, which serves for severing the thread 8 if, upon exceeding or falling-below of the predetermined thread tension or respectively thread tensile force, by response of the thread sensor appropriate control commands in the sense of a switching-off of the thread processing location are issued.

The invention is not confined to details of the foregoing example and many variations and modifications are possible within the scope of the invention as defined by the appended claims. For example, the member 12.2 may be supported by a pneumatic device, e.g. a piston, instead of a spring, such as the compression spring 17.

What is claimed is:

1. A thread monitoring mechanism adapted for use in a textile machine for sensing variations in tension of traveling thread from a predetermined value for use in controlling the travel of the thread; said mechanism comprising:

a housing adapted to be mounted on the textile machine in the path of thread travel;

a swivel lever mounted on said housing for movement about a swivel axis;

a thread guide roller for being engaged by the traveling thread and mounted on said swivel lever for movement thereof under the influence of variations in the tension of the traveling thread from a predetermined value;

switch means adapted to be connected to the textile machine for controlling the travel of the thread;

a switching member carried on said swivel lever for actuation of said switch means upon movement of said swivel lever caused by a variation in the tension of the traveling thread; and a plurality of support means contacting said swivel lever for providing predetermined support against movement of said swivel lever for providing the predetermined value of thread tension, said support means including multiple pneumatic support means for being individually and selectively pressurized.

2. A thread monitoring mechanism, as set forth in claim 1, in which each of said pneumatic support means includes a piston member engaging said swivel lever, an elastically deformable diaphragm engaging and supporting said piston, and means for supplying pneumatic pressure against said diaphragm for regulating the strength of the support thereof.

3. A thread monitoring mechanism, as set forth in claim 2, in which each of said means for supplying pneumatic pressure comprise means for supplying different partially overlapping ranges of pneumatic pressure.

4. A thread monitoring mechanism, as set forth in claim 2, in which each of said diaphragms have effective diaphragm surfaces of different sizes, and in which each of said means for supplying pneumatic pressure includes a common source of pressure and a common pressure regulator.

5. A thread monitoring mechanism, as set forth in claim 1 or 2, in which said support means further includes a compression spring means of predetermined strength.

6. A thread monitoring mechanism, as set forth in claim 1, in which said swivel lever comprises two lever arms, and in which one lever arm carries said switching member and the other lever arm contacts said support means.

7. A thread monitoring mechanism, as set forth in claim 1 or 6, in which said switch means includes a pin member, and said switching member comprises a fork-shaped member into which said pin member projects.

8. A thread monitoring mechanism, as set forth in claim 1, further including a stop means for selectively engaging said swivel lever to hold the swivel lever in fixed position prior to said mechanism receiving a traveling thread.

9. A thread monitoring mechanism, as set forth in claim 1, further including a pneumatically actuatable thread severing means controlled by actuation of said switch means.

* * * * *

UNITED STATES PATENT AND TRADEMARK OFFICE

CERTIFICATE OF CORRECTION

PATENT NO. : 5,156,348

DATED : October 20, 1992

INVENTOR(S) : Siegfried Inger

It is certified that error appears in the above-identified patent and that said Letters Patent is hereby corrected as shown below:

Column 3, line 46, "to" should be -- of --.

Column 7, line 15, after "2" insert -- or 3 --.

Signed and Sealed this

Fifth Day of October, 1993

*Attest:*

*Attesting Officer*

BRUCE LEHMAN

*Commissioner of Patents and Trademarks*